US009127231B2

(12) United States Patent
Carey et al.

(10) Patent No.: US 9,127,231 B2
(45) **Date of Patent: *Sep. 8, 2015**

(54) HIGH EFFICIENCY LUBRICATING COMPOSITION

(75) Inventors: James Thomas Carey, Medford, NJ (US); S. Galiano-Roth Angela, Mullica Hill, NJ (US); Michael Lewis Blumenfeld, Collingswood, NJ (US); Kathleen Kim Cooper, South River, NJ (US)

(73) Assignee: EXXONMOBIL RESEARCH AND ENGINEERING COMPANY, Annadale, NJ (US)

( * ) Notice: Subject to any disclaimer, the term of this patent is extended or adjusted under 35 U.S.C. 154(b) by 264 days.

This patent is subject to a terminal disclaimer.

(21) Appl. No.: 13/484,757

(22) Filed: May 31, 2012

(65) Prior Publication Data

US 2012/0309658 A1 Dec. 6, 2012

Related U.S. Application Data

(60) Provisional application No. 61/492,018, filed on Jun. 1, 2011.

(51) Int. Cl.

| | |
|---|---|
| ***C10M 105/34*** | (2006.01) |
| ***C07C 7/20*** | (2006.01) |
| ***C10M 105/02*** | (2006.01) |
| ***C10M 109/00*** | (2006.01) |
| ***C10M 111/00*** | (2006.01) |
| ***C10M 115/02*** | (2006.01) |
| ***C10M 111/04*** | (2006.01) |

(52) U.S. Cl.

CPC ..... *C10M 111/04* (2013.01); *C10M 2205/0285* (2013.01); *C10M 2205/223* (2013.01); *C10M 2207/2805* (2013.01); *C10M 2207/2825* (2013.01); *C10M 2207/2835* (2013.01); *C10M 2207/2855* (2013.01); *C10M 2207/301* (2013.01); *C10N 2220/021* (2013.01); *C10N 2220/022* (2013.01); *C10N 2230/02* (2013.01); *C10N 2230/06* (2013.01); *C10N 2230/54* (2013.01); *C10N 2240/04* (2013.01)

(58) Field of Classification Search

CPC ..... C10M 2207/281; C10M 2205/02; C10M 2203/02

USPC ..... 508/463; 585/1

See application file for complete search history.

(56) References Cited

U.S. PATENT DOCUMENTS

| | | | |
|---|---|---|---|
| 2,443,264 | A | 6/1948 | Mikeska |
| 2,471,115 | A | 5/1949 | Mikeska |
| 2,526,497 | A | 10/1950 | Mikeska |
| 2,591,577 | A | 4/1952 | McDermott |
| 2,719,125 | A | 9/1955 | Roberts |
| 2,719,126 | A | 9/1955 | Fields et al. |
| 3,087,932 | A | 4/1963 | Little |
| 3,149,178 | A | 9/1964 | Hamilton et al. |
| 3,382,291 | A | 5/1968 | Brennan |
| 3,742,082 | A | 6/1973 | Brennan |
| 3,769,363 | A | 10/1973 | Brennan |
| 3,770,854 | A | 11/1973 | Morris et al. |
| 3,780,128 | A | 12/1973 | Shubkin |
| 3,876,720 | A | 4/1975 | Heilman et al. |
| 4,149,178 | A | 4/1979 | Estes |
| 4,172,855 | A | 10/1979 | Shubkin et al. |
| 4,239,930 | A | 12/1980 | Allphin et al. |
| 4,367,352 | A | 1/1983 | Watts, Jr. et al. |
| 4,413,156 | A | 11/1983 | Watts, Jr. et al. |
| 4,434,408 | A | 2/1984 | Baba et al. |
| 4,501,678 | A | 2/1985 | Katayama et al. |
| 4,704,491 | A | 11/1987 | Tsutsui et al. |
| 4,758,362 | A | 7/1988 | Butke |
| 4,798,684 | A | 1/1989 | Salomon |
| 4,827,064 | A | 5/1989 | Wu |
| 4,827,073 | A | 5/1989 | Wu |
| 4,910,355 | A | 3/1990 | Shubkin et al. |
| 4,914,254 | A | 4/1990 | Pelrine |
| 4,926,004 | A | 5/1990 | Pelrine et al. |
| 4,941,984 | A | 7/1990 | Chamberlain, III et al. |
| 4,956,122 | A | 9/1990 | Watts et al. |
| 4,967,032 | A | 10/1990 | Ho et al. |
| 5,034,141 | A | 7/1991 | Beltzer et al. |
| 5,034,142 | A | 7/1991 | Habeeb et al. |
| 5,068,487 | A | 11/1991 | Theriot |

(Continued)

FOREIGN PATENT DOCUMENTS

| | | | |
|---|---|---|---|
| EP | 0088453 | A1 | 9/1983 |
| EP | 0613873 | A1 | 2/1994 |

(Continued)

OTHER PUBLICATIONS

International Search Report with Written Opinion of PCT/US2012/040333 dated Sep. 27, 2012.

(Continued)

*Primary Examiner* — Vishal Vasisth

(74) *Attorney, Agent, or Firm* — Derek M. Kato; Robert A. Migliorini

(57) ABSTRACT

The lubricating composition of this invention is primarily comprised of an admixture of an API Group V base oil component and a polyolefin base oil component. In general, the blend components include at least 45 wt. % of a Group V base oil component having a kinematic viscosity of less than 20 cSt at 100° C., and from 10 wt. % to 60 wt. % of a polyolefin base oil component having a kinematic viscosity of at least 500 cSt and not greater than 4000 cSt at 100° C. The lubricating composition has improved efficiency and lower operating temperatures, comparable to polyalkylene glycol-based lubricant level, which provides improved machine life and seal life, relative to other lubricating compositions.

20 Claims, No Drawings

(56) References Cited

U.S. PATENT DOCUMENTS

| | | | | |
|---|---|---|---|---|
| 5,084,197 | A | 1/1992 | Galic et al. | |
| 5,087,788 | A | 2/1992 | Wu | |
| 5,602,086 | A | 2/1997 | Le et al. | |
| 5,688,887 | A | 11/1997 | Bagheri et al. | |
| 5,693,598 | A | 12/1997 | Abraham et al. | |
| 6,043,401 | A | 3/2000 | Bagheri et al. | |
| 6,133,209 | A | 10/2000 | Rath et al. | |
| 6,414,090 | B2 | 7/2002 | Minami et al. | |
| 6,414,091 | B2 | 7/2002 | Moritomi et al. | |
| 6,706,828 | B2 | 3/2004 | DiMaio | |
| 6,713,438 | B1 | 3/2004 | Baillargeon et al. | |
| 7,790,660 | B2 | 9/2010 | Carey et al. | |
| 2003/0055184 | A1 | 3/2003 | Song et al. | |
| 2004/0147693 | A1 | 7/2004 | DiMaio | |
| 2007/0000807 | A1 | 1/2007 | Wu et al. | |
| 2008/0020954 | A1 | 1/2008 | Haigh et al. | |
| 2009/0036725 | A1 | 2/2009 | Wu et al. | |
| 2011/0177989 | A1 * | 7/2011 | Bouffet | 508/507 |

FOREIGN PATENT DOCUMENTS

| | | | |
|---|---|---|---|
| WO | 9623751 | A1 | 8/1996 |
| WO | 03020856 | A1 | 3/2003 |
| WO | 03064571 | A1 | 8/2003 |
| WO | 2006083632 | A1 | 8/2006 |
| WO | 2007146081 | A1 | 12/2007 |
| WO | 2010038147 | A1 | 4/2010 |

OTHER PUBLICATIONS

Rodrigues, Ferdinand, The Molecular Weight of Polymers, Principles of Polymer Systems, 1970, 115-144, Chapter 6, McGraw-Hill Book.

Bronshteyn, Lev A. et al., "Energy Efficiency of Industrial Oils," Tribology Transactions, 1999, vol. 42, Issue 4, pp. 771-776.

* cited by examiner

HIGH EFFICIENCY LUBRICATING COMPOSITION

CROSS-REFERENCE TO RELATED APPLICATION

This application claims benefit of 61/492,018, filed Jun. 1, 2011.

FIELD OF THE INVENTION

This invention is directed to a lubricating composition. In particular, this invention is directed to a lubricating composition that is comprised of a blend or admixture of a low viscosity Group V base oil component and a high viscosity polyolefin base oil component.

BACKGROUND OF THE INVENTION

Certain industrial machinery requires high viscosity lubricating compositions, for example gears, bearings, couplings, and pumps. There are several known high viscosity lubricating compositions for such machinery.

U.S. Pat. No. 7,790,660 to Carey et al. discloses polyalkylene glycol (PAG) lubricants including rust inhibiting compositions used in worm drive gear boxes. The rust inhibitors consist of an N-acyl sarcosine and an imidazole while the antioxidant consists of an alkylated diphenyl amine and a hindered phenol. These lubricants deliver lower operating temperature in worm drive gear boxes.

U.S. Pat. No. 5,602,086 to Shim et al. discloses a lubricating composition of enhanced thermal and oxidation stability. The lubricating composition is produced from a blend of components including an API Group V base stock, such as alkylated naphthalene having a kinematic viscosity of 13 cSt at 100° C.; and a polyalphaolefin (PAO) base stock having a kinematic viscosity of 300 cSt or less at 100° C. An example composition includes 10 weight percent (wt %) alkylated naphthalene having a kinematic viscosity of 5 cSt at 100° C.; 87.62 wt % polyalphaolefin (PAO) base stock having a kinematic viscosity of 100 cSt at 100° C.; and 2.38 wt % additives.

US 2008/0020954 to Carey et at discloses a lubricating composition for worm drive gears comprising a blend of polyalphaolefin base stocks having viscosity differences of at least 200 cSt. The polyalphaolefin base stocks may be reaction products of metallocene catalysts. An example lubricating composition includes at least 19.7 wt % of a first polyalphaolefin base stock having a kinematic viscosity of at least 300 cSt at 100° C.; at least 29.0 wt % of a second polyalphaolefin base stock having a kinematic viscosity less than 60 cSt at 100° C.; and not greater than 13.3 wt % of an API Group V base stock, for example alkylnaphthalene or alkylbenzene.

US 2007/0000807 to Wu et al. discloses a lubricating composition for worm drive gears produced from a blend of an API Group V base stock, for example alkylnapthalene or alkylbenzene; and a polyalphaolefin base stock. An example composition includes 20.0 wt % of the API Group V base stock, and 78.25 wt % of the polyalphaolefin base stock.

US 2009/0036725 to Wu et al. discloses liquid a polyalphaolefin and process for producing the polyalphaolefin. The liquid polyalphaolefins (PAOs) are produced in the presence of a meso-metallocene catalyst with a non-coordinating anion activator and, optionally, a co-activator. The PAOs can be combined with one or more other base stocks, including Group I to Group VI base stocks with viscosity range from 1.5 to 100 cSt at 100° C. to formulate suitable viscosity grades of finished oils.

The operating temperature and efficiency of any lubricating composition is especially important to the designers, builders, and user of certain industrial machinery, such as worm drive gear boxes for material handling systems. A higher percentage efficiency rating for a lubricating composition results in more power being transmitted through the machinery and less power being wasted to friction or heat. For example, a 3% efficiency gain in a baggage handling system with 300 worm drive gear boxes is worth about $15,000 per year in electricity savings. A decrease of 10° C. of operating temperature can double the life of seals used in the machinery, and decrease overall costs of operation and ownership. Thus, designers, builders, and users of such machinery are constantly striving to obtain more efficient lubricants.

SUMMARY OF THE INVENTION

This invention provides a lubricating composition that has improved operating temperature and efficiency when used in certain machinery, such as industrial worm drive gear boxes, compared to other lubricating compositions. The lubricating composition absorbs less water than other higher efficient lubricants, such as polyalkylene glycol (PAG) lubricants. The lubricating composition includes high quality base stocks in an amount sufficient such that there is less need for performance enhancing additives.

According to one aspect of the invention, there is provided a lubricating composition comprising a blend or admixture of components. According to another aspect of the invention, there is provided a method for producing the lubricating composition, which comprises blending the components together. According to a further aspect of the invention, there is provided a method for improving the efficiency of machinery comprising the step of lubricating machinery with the inventive lubricating compositions, as compared to mineral-based or PAO-based lubricating compositions that do not contain the claimed amounts Group V and polyolefin base oil components.

The blend components include at least 45 wt. % of the Group V base oil component, based on the total weight of the blend components that are used to produce the lubricating composition. The Group V base oil component having a kinematic viscosity of less than 20 cSt at 100° C.

The blend components further include from 10 wt. % to 60 wt. % of a polyolefin base oil component, based on the total weight of the blend components that are used to produce the lubricating composition. The polyolefin base oil component has a kinematic viscosity of at least 500 cSt and not greater than 4000 cSt at 100° C.

In one embodiment, the blend components are comprised of not greater than 85 wt. % of the Group V base oil component, based on the total weight of the blend components that are used to produce the lubricating composition. Preferably, the blend components are comprised of from 50 wt. % to 85 wt. % of the a Group V base oil component, based on the total weight of the blend components that are used to produce the lubricating composition.

In another embodiment, the Group V base oil component has an aniline point of at least −5° C.

Additionally, or alternately, the Group V base oil component is one or more Group V base stocks selected from the group consisting of alkylated aromatics and esters.

Additionally or alternately, the Group V base oil component has a hygroscopicity (water absorbed) less than that of glycol.

Additionally or alternately, the Group V base oil component contains not greater than 20 wt %, preferably not greater than 10 wt. %, total glycol and polyglycol compounds, based on the total weight of the blend components that are used to produce the Group V base oil component.

The polyolefin base oil component can have a $M_w$ of about 200,000 or less, as well as a MWD of greater than 1 and less than 5. The polyolefin base oil component can also have a viscosity index of greater than 60.

Additionally or alternately, the polyolefin base oil component is comprised of less than 5 wt % of polyolefin with $C_{20}$ or lower carbon numbers.

The lubricating composition is preferably a fully synthetic oil, although it can be a partial synthetic. In one embodiment, the lubricant composition is comprised of a blend of components containing not greater than 5 wt % of any of a Group I-III base oil component.

The lubricating composition can be blended to a kinematic viscosity of from 135 cSt to 7,500 cSt at 40° C. or an ISO VG grade of from 150 to 6,800.

Additionally or alternately, the Group V base oil component and polyolefin base oil component together comprise at least 90 wt. % of the lubricating composition.

DETAILED DESCRIPTION OF THE INVENTION

I. Introduction

The lubricating composition of this invention is primarily comprised of a blend or admixture of a Group V base oil component and a high viscosity polyolefin base oil component. The lubricating composition has improved efficiency, machine life, and seal life, relative to other lubricating compositions. The lubricating composition enables power to be efficiently transported through the machinery in which the lubricating composition is used, so that little power is wasted to friction or heat.

Another advantage of the lubricating composition of this invention is that the base oil components include polar base stock that is low in hygroscopic nature. Thus, there is reduced water absorption which leads to enhanced protection against rust and corrosion.

The lubricating composition of this invention is primarily comprised of a specific blend of a Group V base oil component and at least one base oil component of a polyalphaolefin or polyinternalolefin that provide the desired characteristics of the lubricating composition. This means that little if any other additive components are needed. Since the use of additives at higher concentrations can contribute to inefficiency of machine operation, the use of the lubricating composition of this invention can provide increased efficiency of operation relative to lubricating compositions that include a variety of additives.

The lubricating compositions of this invention provide advantages over compositions comprised of a high viscosity PAO, a low viscosity PAO, and low content of a Group V base stock. The high Group V content (e.g., greater than 45 wt. %) of the inventive lubricating compositions imparts improved solvency to the formulation and provides improved additive and degradation product stability. This results from the increase in amount of polar base stock. In embodiments of the invention that contain no low viscosity PAO, blending complexity is also reduced.

II. Low Viscosity Group V Base Oil Component

The lubricating composition comprises an API Group V base oil component. The Group V base oil component is a Group V base stock or a blend of more than one Group V base stock. Group V base stocks include all other base stocks not included in Group I, II, III, or IV, as set forth in APPENDIX E—API BASE OIL INTERCHANGEABILITY GUIDELINES FOR PASSENGER CAR MOTOR OILS AND DIESEL ENGINE OILS, July 2009 Version. Group I base stocks contain less than 90 percent saturates, tested according to ASTM D2007 and/or greater than 0.03 percent sulfur, tested according to ASTM D1552, D2622, D3120, D4294, to D4927; and a viscosity index of greater than or equal to 80 and less than 120, tested according to ASTM D2270. Group II base stocks contain greater than or equal to 90 percent saturates; less than or equal to 0.03 percent sulfur; and a viscosity index greater than or equal to 80 and less than 210. Group III base stocks contain greater than or equal to 90 percent saturates; less than or equal to 0.03 percent sulfur; and a viscosity index greater than or equal to 120. Group IV base stocks are polyalphaolefins (PAOs).

The terms "base oil" and "base stock" as referred to herein are to be considered consistent with the definitions as also stated in aforementioned API APPENDIX E. According to Appendix E, base oil is the base stock or blend of base stocks used in an API-licensed oil. Base stock is a lubricant component that is produced by a single manufacturer to the same specifications (independent of feed source or manufacturer's location); that meets the same manufacturer's specification; and that is identified by a unique formula, product identification number, or both.

In one embodiment, the Group V base oil component is one or more Group V base stocks selected from the group consisting of alkylated aromatics and esters. Examples of alkylated aromatics include, but are not limited to alkylnaphthalenes and alkylbenzenes.

The alkylnaphthalenes can include a single alkyl chain (monalkylnaphthalene), two alkyl chains (dialkylnaphthatene), or multiple alkyl chains (polyalkylnaphthalene). The alkylbenzenes can include a single alkyl chain (monalkylbenzene), two alkyl chains (dialkylbenzne), or multiple alkyl chains (polyalkylbenzene). Each alkyl group present can be independently represented by a $C_1$-$C_{30}$ alkyl group, which can be linear or branched.

Examples of esters include, but are not limited to polyol esters (reaction products of at least one carboxylic acid, i.e., mono-basic or multi-basic carboxylic acid, and at least one polyol) and complex alcohol esters (reaction products of at least one polyol, multi-basic carboxylic acid and mono-alcohol). Specific examples of polyol esters include, but are not limited to, trimethylolpropane esters of $C_8$-$C_{10}$ acids, di-iso tridecyl adipate, and diiosoctyl ester. A specific example of a carboxylic acid includes, but is not limited to, hexanedioic acid.

Additional examples of esters include esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with any one or more of a variety of alcohols (e.g., butyl alcohol, hexyl alcohol, dodecyl alcohol, 2-ethylhexyl alcohol, ethylene glycol, diethylene glycol monoether, propylene glycol). These esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate and dieicosyl sebacate. Other examples of esters include those made from $C_5$ to $C_{12}$ monocarboxylic acids and polyols and polyol esters such as neopentyl glycol, pentaerythritol, dipentaerythritol and tripentaerythritol.

The Group V base oil component of the lubricating composition of this invention has a blend concentration of at least 45 wt. %, based on the total weight of the blend components that are used to produce the lubricating composition. Preferably, the Group V base oil component of the lubricating composition of this invention has a blend concentration of at least 50 wt. %, based on the total weight of the blend components that are used to produce the lubricating composition.

In order to ensure sufficient quantity of polyalphaolefin or polyinternalolefin base oil component along with the Group V base oil component in the lubricating composition of this invention, the lubricating composition will contain a blend of not greater than 85 wt % of the Group V base oil component, based on the total weight of the blend components that are used to produce the lubricating composition. Preferably, the lubricating composition will contain a blend of not greater than 80 wt %, alternatively not greater than 75 wt %, or not greater than 70 wt % of the Group V base oil component, based on the total weight of the blend components that are used to produce the lubricating composition.

Examples of the ranges of the amount of Group V base oil component that can be blended with the other components of the lubricating composition of this invention include from 45 it to 85 wt %, or 50 wt. % to 80 wt % or 50 wt. % to 75 wt %, based on the total weight of the blend components that are used to produce the lubricating composition.

The Group V base oil component of the lubricating composition of this invention has a kinematic viscosity of less than 20 cSt at 100° C. (Kv 100). The kinematic viscosity of the Group V base oil component is intended to refer to the total content of the Group V base stocks that make up the Group V base oil component, with the kinematic viscosity of the Group V base oil being determined prior to blending with the other components of the lubricating composition of this invention. The kinematic viscosity can be measured according to ASTM D445-10 Standard Test Method for Kinematic Viscosity of Transparent and Opaque Liquids (and Calculation of Dynamic Viscosity).

In an alternative embodiment, the Group V base oil component has a kinematic viscosity of not greater than 15 cSt at 100° C., or not greater than 12 cSt at 100° C., or not greater than 10 cSt at 100° C., or not greater than 8 cSt at 100° C., or not greater than 5 cSt at 100° C. For example, the kinematic viscosity of the Group V base oil component can be within the range of from 1 cSt at 100° C. to not greater than 20 cSt at 100° C., or from 1 cSt at 100° C. to not greater than 15 cSt at 100° C., or from 1 cSt at 100° C. to not greater than 12 cSt at 100° C., or from 1 cSt at 100° C. to not greater than 10 cSt at 100° C., or from 1 cSt at 100° C. to not greater than 8 cSt at 100° C. or from 1 cSt at 100° C. to not greater than 5 cSt at 100° C.

It is highly desirable that the Group V base oil be relatively high in polarity. The Group V base oil component should be sufficiently high in polarity to affect the solubility with the polyalphaolefin or polyinternalolefin base oil.

In general, polarity can be quantified by aniline point, such as according to ASTM D611-07 Standard Test Methods for Aniline Point and Mixed Aniline Point of Petroleum Products and Hydrocarbon Solvents. Lower aniline point indicates higher polarity, and higher aniline point indicates lower polarity.

In one embodiment of the invention, the Group V base oil component of the lubricating composition of the invention has an aniline point of at least −5° C., alternatively an aniline point of at least 0° C. or at least 10° C., or at least 20° C., or at least 40° C. or at least 60° C.

The Group V base oil component has a relatively low hygroscopicity. Hygroscopicity is generally the capacity of a composition to absorb moisture from air.

Hygroscopicity (water absorbed) of the Group V base oil component of the lubricating composition of this invention can be measured after exposure to air under conditions of 80% relatively humidity at one (1) atmosphere and 20° C. for 16 days. The Group V base oil component is evaluated under the stated conditions after 16 days according to ASTM E203-08 Standard Test Method for Water Using Volumetric Karl Fischer Titration.

The hygroscopicity (water absorbed) of the Group V base oil component of this invention will be less than that of glycol. More precisely, the hygroscopicity of the Group V base oil component of this invention will be not greater than 10,000 ppm. More preferably, the hygroscopicity of the Group V base oil component of this invention will be not greater than 5,000 ppm, still more preferably not greater than 2,000 ppm, still more preferably, not greater than 1,000 ppm, and most preferably not greater than 500 ppm.

One convenient way to measure hygroscopicity is on the basis of relative hygroscopicity. The Group V base oil component will have a hygroscopicity less than that of glycol. On a relative basis, with the hygroscopicity of glycol=100, the relative hygroscopicity of the Group V base oil component will be not greater than 80. Preferably, the Group V base oil component of this invention will have a relative hygroscopicity of not greater than 60, more preferably not greater than 40, still more preferably, not greater than 20, and still more preferably, not greater than 20.

The Group V base oil can comprise a quantity of Group V base stocks other than alkylated aromatics and esters. However, the Group V base oil component should not contain any quantity of compounds that contribute to increased hygroscopicity. For example, the Group V base oil component of this invention can contain glycol or polyglycol, including polyalkylene glycol, but at a concentration that will not adversely affect water absorption.

In one embodiment of the invention, the Group V base oil component of the lubricating composition of this invention contains little if any glycol or polyglycol, including polyalkylene glycol. Preferably, the Group V base oil component will contain not greater than 20 wt. %, preferably not greater than 10 wt. %, more preferably not greater than 5 wt. %, and even more preferably not greater than 1 wt. % total glycol and polyglycol compounds, based on the total weight of the blend components that are used to produce the Group V base oil component.

III. High Viscosity Polyalphaolefin or Polyinternalolefin Base Oil Component

The lubricating composition of this invention comprises a high viscosity polyolefin base oil component that mixes well with the Group V base oil component. The combination of the high viscosity polyolefin base oil component and the Group V component provide a high quality lubricating composition, without having to use substantial quantities of non-base stock additives.

The polyolefin can be a polyalphaolefin (i.e., Group IV base oil) or a polyinternalolefin. Preferably, the polyolefin is a polyalphaolefin (i.e., Group IV base oil).

The high viscosity polyolefin base oil component can be a single type of polyolefin base stock such as a metallocene derived polyalphaolefin base stock or as a blend of different types of polyolefin base stocks such as a blend of a metallocene derived polyalphaolefin base stock and a non-metallocene derived polyalphaolefin base stock. The high viscosity polyolefin base oil component will, however, have a kinematic viscosity of greater than 500 cSt at 100° C., with the viscosity being measured prior to blending with the additional components of the lubricating composition.

Depending upon the particular use, higher viscosities are also desirable. In some uses, the polyolefin base oil component will have a kinematic viscosity of at least 600 cSt at 100°

C., or at least 700 cSt at 100° C. or at least 800 cSt at 100° C. The kinematic viscosity should, however not be so high as to negatively impact flow characteristics. Preferably, the kinematic viscosity will not be greater than 4,000 cSt at 100° C.

In a particular embodiment of invention, the polyolefin base oil component will have a kinematic viscosity at 100° C. of from greater than 500 cSt to about 4000 cSt, preferably from at least 600 cSt to about 3000 cSt.

The polyolefin base oil component of the lubricating composition of this invention is preferably a liquid polyalphaolefin composition. The polyolefin can be Obtained by polymerizing at least one monomer, e.g., 1-olefin, in the presence of hydrogen and a catalyst composition.

The polyolefin, particularly the polyalphaolefin, base oil component of the lubricating composition of this invention has a blend concentration of from 10 wt. % to 60 wt. %, based on the total weight of the blend components that are used to produce the lubricating composition. The higher the kinematic viscosity, the less quantity of polyolefin base oil component that will be needed. Preferably, the polyolefin base oil component of the lubricating composition of this invention has a blend concentration of from 15 wt. % to 60 wt. %, alternatively from 20 wt. % to 60 wt. %, or from 25 wt. % to 55 wt. % or from 30 wt. % to 50 wt. %, based on the total weight of the blend components that are used to produce the lubricating composition.

Alpha-olefins suitable for use in the preparation of the saturated, liquid polyalphaolefin polymers described herein contain from 2 to about 30, preferably from 2 to 20, carbon atoms, and more preferably from about 6 to about 14 carbon atoms. Non-limiting examples of such alpha-olefins include ethylene, propylene, 2-methylpropene, 1-butene, 3-methyl-1-butene, 1-pentene, 4-methyl-1-pentene, 1-hexene, 1-heptene, 1-octene, 1-nonene, 1-decene, 1-undecene, 1-dodecene, tridecene, 1-tetradecene, 1-pentadecene, 1-hexadecene, 1-heptadecene, 1-octadecene, 1-nonadecene, and 1-eicosene, including mixtures of at least two of the alpha-olefins. Preferred alpha-olefins for use herein are 1-hexene, 1-octene, decease, 1-dodecene, and 1-tetradecene, including mixtures thereof.

Specifically, the polyalphaolefins (PAOs) that can be used according to this invention can be produced by polymerization of olefin feed in the presence of a catalyst such as $AlCl_3$, $BF_3$, or promoted $AlCl_3$, $BF_3$. Processes for the production of such PAOs are disclosed, for example, in the following patents: U.S. Pat. Nos. 3,149,178; 3,382,291; 3,742,082; 3,769,363; 3,780,128; 4,172,555 and 4,956,122, which are fully incorporated by reference. Additional PAOs are also discussed in: Will, J. G. *Lubrication Fundamentals*, Marcel Dekker: New York, 1980. Subsequent to polymerization, the PAO lubricant range products are typically hydrogenated in order to reduce the residual unsaturation, generally to a level of greater than 90% of saturation.

High viscosity PAOs that can be used according to the invention can be produced by polymerization of an alpha-olefin in the presence of a polymerization catalyst such as Friedel-Crafts catalysts. These include, for example, boron trichloride, aluminum trichloride, or boron trifluoride, promoted with water, alcohols such as ethanol, propanol, or butanol, with carboxylic acids, or with esters such as ethyl acetate or ethyl propionate or ether such as diethyl ether, diisopropyl ether, etc. (See for example, the methods disclosed by U.S. Pat. Nos. 4,149,178 or 3,382,291.) Other descriptions of PAO synthesis are found in the following patents: U.S. Pat. No. 3,742,082 (Brennan); U.S. Pat. No. 3,769,363 (Brennan); U.S. Pat. No. 3,876,720 (Heilman); U.S. Pat. No. 4,239,930 (Allphin); U.S. Pat. No. 4,367,352 (Watts); U.S. Pat. No. 4,413,156 (Watts); U.S. Pat. No. 4,434,408 (Larkin); U.S. Pat. No. 4,910,355 (Shubkin; U.S. Pat. No. 4,956,122 (Watts); and U.S. Pat. No. 5,068,487 (Theriot).

Another class of HVI-PAOs that can be incorporated as a part of this invention can be prepared by the action of a supported, reduced chromium catalyst with an alpha-olefin monomer. Such PAOs are described in U.S. Pat. No. 4,827,073 (Wu); U.S. Pat. No. 4,827,064 (Wu); U.S. Pat. No. 4,967,032 (Ho et al.); U.S. Pat. No. 4,926,004 (Pelrine et al.); and U.S. Pat. No. 4,914,254 (Pelrine). Commercially available PAOs include SpectraSyn Ultral™ 300 and SpectraSyn Ultra™ 1000. (ExxonMobil Chemical Company, Houston, Tex.).

PAOs made using metallocene catalyst systems can also be used according to this invention. Examples are described in U.S. Pat. No. 6,706,828 (equivalent to US 2004/0147693), where PAOs having KV100s of greater than 1000 cSt are produced from meso-forms of certain metallocene catalysts under high hydrogen pressure with methyl alumoxane as a activator.

PAOs, such as polydecene, using various metallocene catalysts can also be incorporated into the lubricating composition of this invention. Examples of how such PAOs can be produced are described, for example, in WO 96/23751, EP 0 613 873, U.S. Pat. Nos. 5,688,887, 6,043,401, WO 03/020856 (equivalent to US 2003/0055184), U.S. Pat. Nos. 5,087,788, 6,414,090, 6,414,091, 4,704,491 6,133,209, and U.S. Pat. No. 6,713,438.

In one embodiment of the invention, the polyolefin base oil component of this invention has a $M_w$ (weight average molecular weight) of about 200,000 or less, preferably from about 250 to 200,000, alternatively from about 280 to 150,000, or from about 300 to about 100,000 g/mol.

In another embodiment of the invention, the polyolefin base oil component of this invention has a $M_w/M_n$ (molecular weight distribution or MWD) of greater than 1 and less than 5, preferably less than 4, preferably less than 3, preferably less than 2.5, preferably less than 2. Alternatively, polyolefin base oil component has a $M_w/M_n$ of from 1 to 3.5, alternatively from 1 to 2.5.

In one embodiment, the polyolefin base oil component has a unimodal $M_w/M_n$ determined by size exclusion or gel permeation chromatograph. In another embodiment, the polyolefin base oil component has a multi-modal molecular weight distribution, where the MWD can be greater than 5. In another aspect, the polyolefin base oil component has a shoulder peak either before or after, or both before and after the major unimodal distribution. In this case, the MWD can be broad (>5) or narrow (<5 or <3 or <2), depending on the amount and size of the shoulder.

For many applications when superior shear stability, thermal stability or thermal/oxidative stability is preferred, it is preferable to have the polyolefins made with the narrowest possible MWD. PAO fluids with different viscosities, but made from the same feeds or catalysts, usually have different MWDs. In other words, MWDs of PAO fluids are dependent on fluid viscosity. Usually, lower viscosity fluids have narrower MWDs (smaller MWD value) and higher viscosity fluids have broader MWDs (larger MWD value). For a polyolefin base oil component with 100° C. Kv of less than 1000 cSt, the MWD of is preferably less than 2.5, and typically around 2.0±0.5. A polyolefin base oil component with a 100° C. viscosity greater than 1000 cSt can have broader MWDs, usually greater than 1.8.

Molecular weight distribution (MWD), defined as the ratio of weight-averaged MW to number-averaged MW (=Mw/Mn), can be determined by gel permeation chromatography (GPC) using polystyrene standards, as described in p. 115 to 144, Chapter 6, The Molecular Weight of Polymers in "Principles of Polymer Systems" (by Ferdinand Rodrigues, McGraw-Hill Book, 1970). The GPC solvent was HPLC Grade tetrahydrofuran, uninhibited, with a column temperature of 30° C., a flow rate of 1 ml/min, and a sample concentration of 1 wt %, and the Column Set is a Phenogel 500 A, Linear, 10E6A.

PAOs made using metallocene catalyst systems may have a substantially minor portion of a high end tail of the molecular weight distribution. Preferably, these PAOs have not more than 5.0 wt % of polymer having a molecular weight of greater than 45,000 Daltons. Additionally or alternately, the amount of the PAO that has a molecular weight greater than 45,000 Daltons is not more than 1.5 wt %, or not more than 0.10 wt %. Additionally or alternately, the amount of the PAO that has a molecular weight greater than 60,000 Daltons is not more than 0.5 wt %, or not more than 0.20 wt %, or not more than 0.1 wt %. The mass fractions at molecular weights of 45,000 and 60,000 can be determined by GPC, as described above.

In a preferred embodiment of this invention, the polyolefin base oil component has a pour point of less than 25° C. (as measured by ASTM D 97), preferably less than 0° C., preferably less than −10° C., preferably less than −20° C., preferably less than −25° C., preferably less than −30° C., preferably less than −35° C., preferably less than −40° C., preferably less than −55° C., preferably from −10° C. to −80° C., preferably from 15° C. to −70° C.

Preferably, the polyolefin base oil component has a peak melting point ($T_m$) of 0° C. or less, and preferably have no measurable Tm. "No measurable Tm" is defined to be when there is no clear melting as observed by heat absorption in the DSC heating cycle measurement. Usually the amount of heat absorption is less than 20 J/g. It is preferred to have the heat release of less than 10 J/g, preferred less than 5 J/g, more preferred less than 1 J/g. Usually, it is preferred to have lower melting temperature, preferably below 0° C., more preferably below −10° C., more preferably below −20° C., more preferably below −30° C., more preferably below −40° C., most preferably no clear inciting peak in DSC.

Peak melting point ($T_m$), crystallization temperature ($T_c$), heat of fusion and degree of crystallinity (also referred to as % crystallinity) can be determined using the following procedure. Differential scanning calorimetric (DSC) data is Obtained using a TA Instruments model 2920 machine. Samples weighing approximately 7-10 mg are sealed in aluminum sample pans. The DSC data can be recorded by first cooling the sample to −100° C., and then gradually heating to 30° C. at a rate of 10° C./minute. The sample can be kept at 30° C. for 5 minutes before a second cooling-heating cycle is applied. Both the first and second cycle thermal events should be recorded. Areas under the curves are preferably measured and used to determine the heat of fusion and the degree of crystallinity. Additional details of such procedure is described in US Patent Pub. No. 2009/0036725.

In one embodiment of the invention, the polyolefin base oil component is preferred to have no appreciable cold crystallization in DSC measurement. During the heating cycle for the DSC method as described above, the PAO may crystallize if it has any crystallizable fraction. This cold crystallization can be observed on the DSC curve as a distinct region of heat release. The extent of the crystallization can be measured by the amount of heat release. Higher amount of heat release at lower temperature means higher degree of poor low temperature product. The cold crystallization is usually less desirable, as it may mean that the fluid may have very poor low temperature properties—not suitable for high performance application. It is preferred to have less than 20 j/g of heat release for this type of cold crystallization, preferred less than 10 j/g, less than 5 j/g and less than 1 j/g, most preferably to have no observable heat release due to cold crystallization during DSC heating cycle.

In another preferred embodiment, the polyolefin base oil component will have a viscosity index (VI) of greater than 60, preferably greater than 100, more preferably greater than 120, preferably at least 160 and more preferably at least 180. VI is determined according to ASTM Method D2270-93 (1998). VI of a fluid is usually dependent on the viscosity, feed composition and method of preparation. Higher viscosity fluid of the same feed composition usually has higher VI. The typical VI range for fluids made from $C_2$ or $C_3$ or $C_4$ or $C_5$ linear alpha-olefin (LAO) will typically be from 65 to 250. Typical VI range for fluids made from $C_6$ or $C_7$ will be from 100 to 300, depending on fluid viscosity. Typical VI range for fluids made from $C_8$ to $C_{14}$ LAO, such as 1-octene, 1-nonene, 1-decene or 1-undecene or 1-dodecene, 1-tetradecene, are from 120 to >450, depending on viscosity. More specifically, the VI range for fluids made from 1-decene or 1-decene equivalent feeds are from about 100 to about 500, preferably from about 120 to about 400. Two or three or more alpha-olefins can be used as feeds, such as combination of $C_2+C_3$, $C_2+C_{10}$, $C_2+C_{14}$, $C_2+C_{16}$, $C_2+C_{18}$, $C_3+C_{10}$, $C_3+C_{14}$, $C_3+C_{16}$, $C_3+C_{18}$, $C_4+C_8$, $C_4+C_{12}$, $C_4+C_{16}$, $C_3+C_4+C_8$, $C_3+C_4+C_{12}$, $C_4+C_{10}+C_{12}$, $C_4+C_{10}+C_{14}$, $C_6+C_{12}$, $C_6+C_{12}C_{14}$, $C_4+C_6+C_{10}+C_{14}$, $C_4+C_6+C_8+C_{10}+C_{12}+C_{14}+C_{16}+C_{18}$, etc. The product VI depends on the fluid viscosity and also on the choice of feed olefin composition. For the most demanding lubricant applications, it is better to use fluids with higher VI.

In another embodiment, it is preferable that the PAO base oil does not contain a significant amount of very light fraction. These light fractions contribute to high volatility, unstable viscosity, poor oxidative and thermal stability. They are usually removed in the final product. It is generally preferable to have less than 5 wt % of the polyolefin base oil with $C_{20}$ or lower carbon numbers, more preferably less than 10 wt % of the polyolefin base oil with $C_{24}$ or lower carbon numbers or more preferably less than 15 wt % of the polyolefin base oil with $C_{26}$ or lower carbon numbers. It is preferable to have less than 3 wt % of the polyolefin base oil with $C_{20}$ or lower carbon numbers, more preferably less than 5 wt % of the polyolefin base oil with $C_{24}$ or lower carbon numbers or more preferably less than 8 wt % of the polyolefin base oil with $C_{26}$ or lower carbon numbers. It is preferable to have less than 2 wt % of the polyolefin base oil with $C_{20}$ or lower carbon numbers, more preferably less than 3 wt % of the polyolefin base oil with $C_{24}$ or lower carbon numbers or more preferably less than 5 wt % of the polyolefin base oil with $C_{26}$ or lower carbon numbers. Also, the lower the amount of any of these light hydrocarbons, the better the fluid property of the polyolefin base oil as can be determined by Noack volatility testing (ASTM D5800).

In general, Noack volatility is a strong function of fluid viscosity. Lower viscosity fluid usually has higher volatility and higher viscosity fluid has lower volatility. Preferably, the polyolefin base oil has a Noack volatility of less than 30 wt %, preferably less than 25 wt %, preferably less than 10 wt %, preferably less than 5 wt %, preferably less than 1 wt %, and preferably less than 0.5 wt %.

In another embodiment, the polyolefin base oil has a dielectric constant of 3 or less, usually 2.5 or less (1 kHz at 23° C., as determined by ASTM D 924).

In another embodiment, the polyolefin base oil can have a specific gravity of 0.6 to 0.9 g/cm$^3$, preferably 0.7 to 0.88 g/cm$^3$.

In another embodiment, the PAOs produced directly from the oligomerization or polymerization process are unsaturated olefins. The amount of unsaturation can be quantitatively measured by bromine number measurement according to the ASTM D 1159, or by proton or carbon-13 NMR. Proton NMR spectroscopic analysis can also differentiate and quantify the types of olefinic unsaturation: vinylidene, 1,2-disubstituted, trisubstituted, or vinyl. Carbon-13 NMR spectroscopy can confirm the olefin distribution calculated from the proton spectrum.

Both proton and carbon-13 NMR spectroscopy can quantify the extent of short chain branching (SCB) in the olefin oligomer, although carbon-13 NMR can provide greater specificity with respect to branch lengths. In the proton spectrum, the SCB branch methyl resonances fall in the 1.05-0.7 ppm range. SCBs of sufficiently different length will give methyl peaks that are distinct enough to be integrated separately or deconvoluted to provide a branch length distribution. The remaining methylene and methine signals resonate in the 3.0-1.05 ppm range. In order to relate the integrals to CH, $CH_2$, and $CH_3$ concentrations, each integral must be corrected for the proton multiplicity. The methyl integral is divided by three to derive the number of methyl groups; the remaining aliphatic integral is assumed to comprise one CH signal for each methyl group, with the remaining integral as $CH_2$ signal. The ratio of $CH_3/(CH+CH_2+CH_3)$ gives the methyl group concentration.

Similar logic applies to the carbon-13 NMR analysis, with the exception that no proton multiplicity corrections need be made. Furthermore, the enhanced spectral/structural resolution of $^{13}C$ NMR vis a is $^{1}H$ NMR allows differentiation of ions according to branch lengths. Typically, the methyl resonances can be integrated separately to give branch concentrations for methyls (20.5-15 ppm), propyls (15-14.3 ppm), butyl-and-longer branches (14.3-13.9 ppm), and ethyls (13.9-7 ppm).

Olefin analysis is readily performed by proton NMR, with the olefinic signal between 5.9 and 4.7 ppm subdivided according to the alkyl substitution pattern of the olefin. Vinyl group CH protons resonate between 5.9-5.7 ppm, and the vinyl $CH_2$ protons between 5.3 and 4.85 ppm. 1,2-disubstituted olefinic protons resonate in the 5.5-5.3 ppm range. The trisubstituted olefin peaks overlap the vinyl $CH_2$ peaks in the 5.3-4.85 ppm region; the vinyl contributions to this region are removed by subtraction based on twice the vinyl CH integral. The 1,1-disubstituted- or vinylidene-olefins resonate in the 4.85-4.6 ppm region. The olefinic resonances, once corrected for the proton multiplicities can be normalized to give a mole-percentage olefin distribution, or compared to the multiplicity-corrected aliphatic region (as was described above for the methyl analysis) to give fractional concentrations (e.g. olefins per 100 carbons).

Generally, the amount of unsaturation strongly depends on fluid viscosity or fluid molecular weight. Lower viscosity fluid has higher degree of unsaturation and higher bromine number. Higher viscosity fluid has lower degree of unsaturation and lower bromine number. If a large amount of hydrogen or high hydrogen pressure is applied during the polymerization step, the bromine number can be lower than without the hydrogen presence. Typically, for greater than 300 cSt to 4000 cSt polyalphaolefin produced from 1-decene or other suitable LAOs, the as-synthesized PAO will have bromine number of from 60 to less than 1, but greater than 0, preferably from about 30 to about 0.01, preferably from about 10 to about 0.5, depending on fluid viscosity.

IV. Groups I-III Base Oil Component

The lubricating composition of this invention is substantially a synthetic lubricant. That is, the lubricating composition of this invention can include some amount of any of a Group I-III base oil component. However, the lubricating composition should include not greater than 25 wt. % of a total amount of a Group I-III base oil component. Preferably, the lubricating composition should include not greater than 20 wt. %, more preferably not greater than 15 wt. %, and most preferably not greater than 5 wt. % of a total amount of a Group I-III base oil component, based on the total weight of the blend components that are used to produce the lubricating composition.

V. Additives

Lubricating Oil Flow Improver

Pour point depressants, otherwise known as lube oil flow improvers, lower the minimum temperature at which the fluid will flow or can be poured. Such additives are well known. Examples of such additives that improve the low temperature fluidity of the fluid are $C_8$ to $C_{18}$ dialkyl fumarate/vinyl acetate copolymers and polyalkylmethacrylates. Due to the advantages provided by the blend of Group V base oil component and the polyolefin base oil component in the lubricating composition of this invention, little if any pour point depressant will be needed. If any pour point depressant is used, it is preferred to include into the lubricating composition a total amount of pour point depressant of not greater than 1 wt. %, more preferably not greater than 0.5 wt. %, based on total weight of the blend components that are used to produce the lubricating composition.

Viscosity Modifier

A viscosity modifier (VM) functions to impart high and low temperature operability to a lubricating oil. A VM may also be considered multifunctional. For example multifunctional viscosity modifiers can also function as dispersants. Examples of such viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene. Due to the advantages provided by the blend of Group V base oil component and the polyolefin base oil component in the lubricating composition of this invention, little if any viscosity modifier will be needed. If any viscosity modifier is used, it is preferred to include into the lubricating composition a total amount of viscosity modifier of not greater than 1 wt. %, more preferably not greater than 0.5 wt. %, based on total weight of the blend components that are used to produce the lubricating composition.

Antiwear Additives

Antiwear additives may be used in the lubricating compositions of the present inventions.

While there are many different types of antiwear additives, a common antiwear additive is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

A variety of non-phosphorous additives are also used as antiwear additives. Sulfurized olefins are useful as antiwear and EP additives. Sulfur-containing olefins can be prepared by sulfurization or various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of it $R^3$-$R^6$ may be connected so as to form a cyclic ring. Additional information concerning sulfurized olefins and their preparation can be found in U.S. Pat. No. 4,941,984.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex (R=$C_8$-$C_{18}$ alkyl) are also useful antiwear agents. The use or addition of such materials should be kept to a minimum if the object is to produce low SAP formulations.

Esters of glycerol may be used as antiwear agents. For example, mono-, di-, and tri-oleates, mono-palmitates and mono-myristates may be used.

ZDDP can be combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothia-diazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cit, and U.S. Pat. Nos. 4,798,684 and 5,084,197, for example.

Useful antioxidants include hindered phenols. These phenolic anti-oxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amine antioxidants have alkyl substituent groups of at least about 6 carbon atoms. Examples of aliphatic groups include hexyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alpha-naphthylamine; and p-octylphenyl-alpha-naphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are know to be particularly useful.

Preferred antioxidants include hindered phenols, arylamines. These antioxidants may be used individually by type or in combination with one another. Such additives may be used in an amount of about 0.01 to 5 wt %, preferably about 0.01 to 1.5 wt %, more preferably zero to less than 1.5 wt %, most preferably zero.

Defoamants

Defoamants may advantageously be added to lubricant compositions. These agents retard the formation of stable foams. Silicones and organic polymers are typical defoamants. For example, polysiloxanes, such as silicon oil or polydimethyl siloxane, provide antifoam properties. Defoamants are commercially available and may be used in conventional minor amounts along with other additives such as demulsifiers; usually the amount of these additives combined is less than 1 percent and often less than 0.1 percent.

Demulsifiers

Demulsifiers include alkoxylated phenols and phenol-formaldehyde resins and synthetic alkylaryl sulfonates. A demulsifying agent is a predominant amount of a water-soluble polyoxyalkylene glycol having a pre-selected molecular weight of any value in the range of between about 450 and 5000 or more. An especially preferred family of water soluble polyoxyalkylene glycol useful in the compositions of the present invention may also be one produced from alkoxylation of n-butanol with a mixture of alkylene oxides to form a random alkoxylated product.

Corrosion Inhibitors

Corrosion inhibitors are used to reduce the degradation of metallic parts that are in contact with the lubricating oil composition. Suitable corrosion inhibitors include thiadiazoles. See, for example, U.S. Pat. Nos. 2,719,125; 2,719,126; and 3,087,932. Such additives may be used in an amount of about 0.01 to 5 wt %, preferably about 0.01 to 1.5 wt %.

Antirust Additives

Antirust additives are additives that protect lubricated metal surfaces against chemical attack by water or other contaminants. A wide variety of these are commercially available; they are referred to in Klamann in Lubricants and Related Products, op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Such additives may be used in an amount of about 0.01 to 5 wt %, preferably about 0.01 to 1.5 wt %.

VI. Formulated Composition

The lubricating composition of this invention is prepared by blending together one or more of the desired Group V base stocks to produce the Group V base oil component. One or more of the desired polyolefin base stocks can be blended together to produce the polyolefin base oil component. The base oil components can then be blended together. Blending can, however, be done in any order, including any additional amount of components that may be desired.

The blended lubricating composition preferably has an ISO grade of 150 to 6,800 and is used in industrial applications, such as industrial worm drive gears. However, in another embodiment, the blended lubricating composition has a corresponding SAE grade of SAE 75W-90, SAE 80W-90, or SAE 85W-90 to SAE 85W-250, and is used in automotive applications, such as automotive gears.

In one embodiment, the blended lubricating composition has a kinematic viscosity of 135 cSt to 7,500 cSt at 40° C. and a corresponding ISO VG grade of 150 to 6,800. The blended lubricating compositions having the ISO VG grades of 150 to 6,800 are acceptable for use in industrial gear applications, such as steel on steel gears or steel on bronze gears. In another embodiment, the blended lubricating composition has a kinematic viscosity of 288 cSt to 748 cSt at 40° C. and a corresponding ISO VG grade of 320 to 680. The blended lubricating compositions having the ISO VG grade of 320 to 680 are acceptable for use in worm drive gears, such as steel on bronze gears. In yet another embodiment, the blended lubricating composition has a kinematic viscosity of 414 cSt to 506 cSt at 40° C. and a corresponding ISO VG grade of 460, and is also acceptable for use in worm drive gear applications, such as worm drive gear boxes of baggage handling systems.

In one embodiment, the blended lubricating composition has a kinematic viscosity of from 45 cSt at 100° C. to 80 cSt at 100° C. In another embodiment, the blended lubricating composition has a kinematic viscosity of from 46 cSt at 100° C. to 76 cSt at 100° C. In yet another embodiment, the blended lubricating composition has a kinematic viscosity of from 50 cSt at 100° C. to 70 cSt at 100° C. The kinematic viscosity is measured according to the ASTM D445 standard test method.

In another embodiment, the blended lubricating composition having a kinematic viscosity of 135 cSt to 7,500 cSt at 40° C. has a corresponding SAE grade of SAE 75W-90, SAE 80W-90, or SAE 85W-90 to SAE 85W-250. The blended lubricating compositions having the SAE grades can be used in automotive gear applications.

In another embodiment, the Group V base oil component and polyolefin base oil component together comprise at least 90 wt. % of the lubricating composition.

In one embodiment, the blended lubricating composition has a viscosity index (VI) of 120 to 300. In another embodiment, the blended lubricating composition has a viscosity index of 132 to 247. In yet another embodiment, the blended lubricating composition has a viscosity index of 138 to 244. The viscosity index is measured according to the ASTM D2270 standard test method.

In one embodiment, the blended lubricating composition provides a shear stability such that the blended lubricating composition has minimal loss of kinematic viscosity during use. The shear stability of the blended lubricating composition is measured according to the CEC L-45-99 standard test method. CEC-L-45-A-99 is an industry standard for measuring fluid shear stability. Details of the test method are available from the Coordinating European Council (CEC), Interlynk Administrative Services Ltd, PO Box 6475, Earl Shilton, Leicester, LE9 9ZB, UK. As alluded to above, the test includes determining the kinematic viscosity loss of the lubricating composition after 20 hours and approximately 1,740,000 revolutions in a tapered roller bearing, which indicates the shear stability of the lubricating composition. Alternatively, the test can be run for 100 hours and approximately 8,700,000 revolutions, rather than 20 hours as specified by the CEC L-45-99 test method. The kinematic viscosity loss can be measured by % viscosity loss relative to the kinematic viscosity of the blended lubricant before the kinematic viscosity test. A lower % loss of kinematic viscosity indicates a higher shear stability which is more desirable.

In one embodiment, the blended lubricating composition has a kinematic viscosity loss of not greater than 13%, relative to the kinematic viscosity of the blended lubricating composition before use. In another embodiment, the blended lubricating composition has a kinematic viscosity loss of not greater than 11%. In yet another embodiment, the blended lubricating composition has a kinematic viscosity loss of not greater than 10%. The low kinematic viscosity loss and thus high shear stability of the blended lubricating composition contributes to the efficiency of the blended lubricating composition.

The oxidative stability of the lubricating composition is measured using the rotary pressure vessel oxidation test (RPVOT), and according to the ASTM D2272 standard test method, which utilizes an oxygen-pressured vessel to evaluate the oxidation stability of the lubricating composition in the presence of water and a copper catalyst coil at 150° C. under an initial pressure of 90 psi. Pressure inside the vessel is recorded while the vessel is rotated at 100 rpm. The amount of time required for a specified drop in pressure is the oxidation stability of the lubricating composition.

In one embodiment, the blended lubricating composition has an oxidation stability of at least 100 minutes, when tested using the RPVOT test. In another embodiment, the blended lubricating composition has an oxidation stability of at least 160 minutes. In yet another embodiment, the blended lubricating composition has an oxidation stability of at least 220 minutes. In yet another embodiment, the blended lubricating composition has an oxidation stability of 100 minutes to 300 minutes.

The blended lubricating composition allows power to be efficiently transported through the machinery in which the lubricating composition is used, so that little power is wasted to friction or heat. The shear stability, viscosity, and other properties of the blended lubricating composition allows the machinery to employ lower operating temperatures, which leads to lower energy consumption and lower energy costs. The lower operating temperature also leads to less degradation of the machinery and seals due to heat, and thus provides a longer machine life and longer seal life. The lubricating composition provides an efficiency of 77% to 80% when used in worm drive gear box applications, which is higher than the efficiency provided by other lubricating compositions including PAOs, which typically provide an efficiency of not greater than 75%. Even a small increase in efficiency, such as a 1% increase provides significant energy cost savings.

The efficiency of the blended lubricating composition, as evaluated in a gearbox, is about equal to polyalkylene glycol (PAG) lubricants. However, as discussed above, the blended lubricating composition provides several advantages over PAG lubricants, such as less water absorption.

In one embodiment, the lubricating composition has an efficiency of 70% to 90%. In another embodiment, the lubricating composition has an efficiency of 75% to 81%. In yet another embodiment, the lubricating composition has an efficiency of 77% to 85%.

According to another aspect of this invention, a method of improving energy efficiency of machinery is provided, comprising the step of lubricating machinery with the inventive lubricating compositions, as compared to mineral-based or PAO-based lubricating compositions that do not contain the claimed amounts Group V and polyolefin base oil components.

VII. Examples

Tables 1 and 3 include nine examples of the inventive lubricating composition and Table 2 includes five comparative examples of other lubricating compositions. Tables 1, 2 and 3 also include the kinematic viscosity at 40° C., kinematic viscosity at 100° C., viscosity index (VI), and efficiency of the lubricating compositions. The inventive examples include a blend comprising the API Group V base oil component and the high viscosity base oil component, as described above. In addition, the inventive examples contain a water level of less than 300 ppm.

Inventive Example A includes 69.65 wt % of the API Group V base oil component. The API Group V base oil component of Example A includes one API Group V base stock. The API Group V base stock of Example A is alkylated naphthalene having a kinematic viscosity of 5 cSt at 100° C. Inventive Example A also includes 30.0 wt % of the high viscosity polyolefin base oil component. The high viscosity polyolefin base oil component of Example A includes one high viscosity polyalphaolefin base stock. The high viscosity polyalphaolefin base stock of Example A is a reaction product a linear alphaolefin and has a kinematic viscosity of 2000 cSt at 100° C. Inventive Example A also includes 0.35 wt % of an additive component.

Inventive Example B includes 66.5 wt % of the API Group V base oil component. The API Group V base oil component of Example B includes one API Group V base stock. The API Group V base stock of Example B is alkylated naphthalene having a kinematic viscosity of 5 cSt at 100° C. Inventive Example B also includes 30.0 wt % of the high viscosity polyolefin base oil component. The high viscosity polyolefin base oil component of Example B includes one high viscosity polyalphaolefin base stock. The high viscosity polyalphaolefin base stock of Example B is a reaction product a linear alphaolefin and has a kinematic viscosity of 2000 cSt at 100° C. Inventive Example B also includes 3.5 wt % of an additive component.

Inventive Example C includes 54.65 wt % of the API Group V base oil component. The API Group V base oil component of Example C includes one API Group V base stock. The API Group V base stock of Example C is alkylated naphthalene having a kinematic viscosity of 5 cSt at 100° C. Inventive Example C also includes 45.0 wt % of the high viscosity polyolefin base oil component. The high viscosity polyolefin base oil component of Example C includes one high viscosity polyalphaolefin base stock. The high viscosity polyalphaolefin base stock of Example C is a reaction product a linear alphaolefin and has a kinematic viscosity of 1000 cSt at 100° C. Inventive Example C also includes 0.35 wt % of an additive component.

Inventive Example D includes 61.65 wt % of the API Group V base oil component. The API Group V base oil component of Example D includes one API Group V base stock. The API Group V base stock of Example D is alkylated naphthalene having a kinematic viscosity of 5 cSt at 100° C. Inventive Example D also includes 38.0 wt % of the high viscosity polyolefin base oil component. The high viscosity polyolefin base oil component of Example D includes one high viscosity polyalphaolefin base stock. The high viscosity polyalphaolefin base stock of Example D is a reaction product a linear alphaolefin and has a kinematic viscosity of 600 cSt at 100° C. Inventive Example D also includes 0.35 wt % of an additive component.

Inventive Example J includes 60.0 wt % of the API Group V base oil component. The API Group V base oil component of Example J includes one API Group V base stock. The API Group V base stock of Example J is alkylated naphthalene having a kinematic viscosity of 12 cSt at 100° C. Inventive Example J also includes 10.0 wt % of the high viscosity polyolefin base oil component. The high viscosity polyolefin base oil component of Example J includes one high viscosity polyalphaolefin base stock. The high viscosity polyalphaolefin base stock of Example J is a reaction product a linear alphaolefin and has a kinematic viscosity of 1100 cSt at 100° C. Inventive Example J also includes 26.6 wt % of a polyalphaolefin base stock with a kinematic viscosity of 150 cSt at 100° C., and 3.4 wt % of an additive component.

Inventive Example K includes 75.0 wt % of the API Group V base oil component. The API Group V base oil component of Example K includes one API Group V base stock. The API Group V base stock of Example K alkylated naphthalene having a kinematic viscosity of 12 cSt at 100° C. Inventive Example K also includes 24.55 wt % of the high viscosity polyolefin base oil component. The high viscosity polyolefin base oil component of Example K includes one high viscosity polyalphaolefin base stock. The high viscosity polyalphaolefin base stock of Example K is a reaction product a linear alphaolefin and has a kinematic viscosity of 600 cSt at 100° C. Inventive Example K also includes 0.45 wt % of an additive component.

Inventive Example L includes 64.65 wt % of the API Group V base oil component. The API Group V base oil component of Example L includes one API Group V base stock. The API Group V base stock of Example L is ester having a kinematic viscosity of 4 cSt at 100° C. Inventive Example L also includes 35.0 wt % of the high viscosity polyolefin base oil component. The high viscosity polyolefin base oil component of Example L includes one high viscosity polyalphaolefin base stock. The high viscosity polyalphaolefin base stock of Example L is a reaction product a linear alphaolefin and has a kinematic viscosity of 2000 cSt at 100° C. Inventive Example L also includes 0.35 wt % of an additive component.

Inventive Example M includes 51.65 wt % of the API Group V base oil component. The API Group V base oil component of Example M includes one API Group V base stock. The API Group V base stock of Example M is ester having a kinematic viscosity of 4 cSt at 100° C. Inventive Example M also includes 48.0 wt % of the high viscosity polyolefin base oil component. The high viscosity polyolefin base oil component of Example M includes one high viscosity polyalphaolefin base stock. The high viscosity polyalphaolefin base stock of Example M is a reaction product a linear alphaolefin and has a kinematic viscosity of 1000 cSt at 100° C. Inventive Example M also includes 0.35 wt % of an additive component.

Inventive Example N includes 56.55 wt % of the API Group V base oil component. The API Group V base oil component of Example N includes one API Group V base stock. The API Group V base stock of Example N is ester having a kinematic viscosity of 4 cSt at 100° C. Inventive Example N also includes 43.0 wt % of the high viscosity polyolefin base oil component. The high viscosity polyolefin base oil component of Example N includes one high viscosity polyalphaolefin base stock. The high viscosity polyalphaolefin base stock of Example N is a reaction product a linear alphaolefin and has a kinematic viscosity of 600 cSt at 100° C. Inventive Example N also includes 0.45 wt % of an additive component.

Comparative Example E includes 15.0 wt % of an API Group V base oil component. The API Group V base oil component of Example E includes one API Group V base stock. The API Group V base stock of Example E is alkylated naphthalene having a kinematic viscosity of 5 cSt at 100° C. Comparative Example E also includes 22.0 wt % of the high viscosity polyolefin base oil component. The high viscosity polyolefin base oil component of Example E includes one high viscosity polyalphaolefin base stock. The high viscosity polyalphaolefin base stock of Example E is a reaction product a linear alphaolefin and has a kinematic viscosity of 2000 cSt at 100° C. Comparative Example E also includes 62.65 wt % of a low viscosity base oil component. The low viscosity polyalphaolefin base stock of Example E has a kinematic viscosity of 20 cSt at 100° C. Comparative Example E also includes 0.35 wt % of an additive component. Comparative Example E can be prepared according to a process similar to processes disclosed in US 2008/0020954 to Carey et. al.

Comparative Example F includes 38.65 wt % of an API Group V base oil component. The API Group V base oil component of Example F includes one API Group V base stock. The API Group V base stock of Example F is alkylated naphthalene having a kinematic viscosity of 5 cSt at 100° C. Comparative Example F also includes 61.0 wt % of a low viscosity polyolefin base oil component. The tow viscosity polyalphaolefin base stock of Example F has a kinematic viscosity of 300 cSt at 100° C. Comparative Example F also includes 0.35 wt % of an additive component. Comparative Example F can be prepared according to the process described in U.S. Pat. No. 5,602,086 to Shim et. al. or US 2007/0000807 to Carey et. al.

Comparative Example G includes 27.65 wt % of an API Group V base oil component. The API Group V base oil component of Example G includes one API Group V base stock. The API Group V base stock of Example G is alkylated naphthalene having a kinematic viscosity of 5 cSt at 100° C. Comparative Example G also includes 72.0 wt % of a low viscosity polyolefin base oil component. The low viscosity polyalphaolefin base stock of Example G has a kinematic viscosity of 150 cSt at 100° C. Comparative Example G also includes 0.35 wt % of an additive component. Comparative Example G can be prepared according to the process described in U.S. Pat. No. 5,602,086 to Shim et. al.

Comparative Example H includes 20.0 wt % of an API Group V base oil component. The API Group V base oil component of Example II includes one API Group V base stock. The API Group V base stock of Example H is alkylated naphthalene having a kinematic viscosity of 5 cSt at 100° C. Comparative Example H also includes 58.0 wt % of a first low viscosity polyolefin base oil component. The first low viscosity polyalphaolefin base stock of Example H has a kinematic viscosity of 100 cSt at 100° C. Comparative Example H also includes 18.5 wt % of a second low viscosity polyolefin base oil component. The second low viscosity polyalphaolefin base stock of Example H has a kinematic viscosity of 40 cSt at 100° C. Comparative Example H also includes 3.5 wt % of an additive component. Comparative Example H can be prepared according to the process described in U.S. Pat. No. 5,602,086 to Shim et. al.

Comparative Example I includes 97.5 wt % of a polyalkylene glycol base stock having a kinematic viscosity of 80 cSt at 100° C. Comparative Example I also includes 2.5 wt % of an additive component.

In Inventive Examples A, C, D, L and M and Comparative Examples E, F and G, the 0.35 wt % additive component includes 0.25 wt % of an antiwear additive and 0.1 wt % of a defoamant. In Inventive Examples K and N, the 0.45 wt % additive component includes 0.25 wt % of an antiwear additive and 0.2 wt % of a defoamant. Inventive Examples B and J and Comparative Example H are fully additized gear or circulation oils with 3.5 wt % or 3.4 wt % additives, including one or more antiwear additives, antioxidants, defoamants, demulsifiers, corrosion inhibitors, and antirust additives.

The efficiency of the inventive lubricating compositions of Examples A-D and J-N and comparative example lubricating compositions of examples E-I is measured using a worm drive gear at 100% rated loaded, 1.1 horsepower, and a 20:1 reduction ratio. The data is shown with a 95% confidence interval via standard statistical analyses. The kinematic viscosity is measured according to the ASTM D445 standard test method and the viscosity index is measured according to the ASTM D2270 standard test method. The efficiency is measured in percent (%) of available energy being used by the worm drive gear.

Tables 1A-1B, 2A-2B and 3A-3B illustrate the blended lubricating compositions. Inventive Examples A-D and J-N and Comparative Examples E-I have comparable kinematic viscosities and viscosity index. The blended lubricating compositions of Inventive Examples A-D and J-N and the lubricating compositions of Comparative Examples E-I meet the ISO VG 460 standard and thus are suitable for use in industrial gear applications, such as worm drive gear boxes.

TABLE 1A

| Component | Kinematic Viscosity (cSt, Kv 100) | Inventive Example A | Inventive Example B | Inventive Example C | Inventive Example D |
|---|---|---|---|---|---|
| AN base stock | 5 | 69.65 wt % | 66.5 wt % | 54.65 wt % | 61.65 wt % |
| PAO base stock | 2000 | 30.0 wt % | 30.0 wt % | | |
| PAO base stock | 1000 | | | 45.0 wt % | |
| PAO base stock | 600 | | | | 38.0 wt % |
| Additives | | 0.35 wt % | 3.5 wt % | 0.35 wt % | 0.35 wt % |

TABLE 1B

| | Inventive Example A | Inventive Example B | Inventive Example C | Inventive Example D |
|---|---|---|---|---|
| Gearbox Efficiency (%) | 78.8 | 78.2 | 78.1 | 77.3 |
| Kv 40 (cSt) | 435.2 | 466.6 | 487.2 | 480.0 |
| Kv 100 (cSt) | 54.1 | 56.6 | 76.3 | 50.2 |
| Viscosity Index (VI) | 191 | 190 | 239 | 166 |

TABLE 2A

| Component | Kinematic Viscosity (cSt, Kv 100) | Comp. Ex. E | Comp. Ex. F | Comp. Ex. G | Comp. Ex. H | Comp. Ex. I |
|---|---|---|---|---|---|---|
| AN base stock | 5 | 15.0 | 38.65 | 27.65 | 20.0 | |
| PAO base stock | 2000 | 22.0 | | | | |
| PAO base stock | 300 | | 61.0 | | | |
| PAO base stock | 150 | | | 72.0 | | |
| PAO base stock | 100 | | | | 58.0 | |
| PAO base stock | 40 | | | | 18.5 | |
| PAO base stock | 20 | 62.65 | | | | |
| PAG base stock | 80 | | | | | 97.5 |
| Additives | | 0.35 | 0.35 | 0.35 | 3.5 | 2.5 |

TABLE 2B

| | Comp. Ex. E | Comp. Ex. F | Comp. Ex. G | Comp. Ex. H | Comp. Ex. I |
|---|---|---|---|---|---|
| Gearbox Efficiency (%) | 74.9 | 75.0 | 75.0 | 75.5 | 78.9 |
| Kv 40 (cSt) | 528.8 | 495.0 | 509.8 | 469.3 | 471.7 |
| Kv 100 (cSt) | 58.1 | 63.6 | 58.0 | 48.5 | 79.9 |
| Viscosity Index (VI) | 179 | 203 | 183.0 | 163.0 | 253.0 |

TABLE 3A

| Component | Kinematic Viscosity (cSt, Kv 100) | Inventive Example J | Inventive Example K | Inventive Example L | Inventive Example M | Inventive Example N |
|---|---|---|---|---|---|---|
| AN base stock | 12 | 60.0 wt % | 75.0 wt % | | | |
| Ester base stock | 4 | | | 64.65 wt % | 51.65 wt % | 56.55 wt % |
| PAO base stock | 2000 | | | 35.0 wt % | | |
| PAO base stock | 1100 | 10.0 wt % | | | | |
| PAO base stock | 1000 | | | | 48.0 wt % | |
| PAO base stock | 600 | | 24.55 wt % | | | 43.0 wt % |
| PAO base stock | 150 | 26.6 wt % | | | | |
| Additives | | 3.4 wt % | 0.45 wt % | 0.35 wt % | 0.35 wt % | 0.45 wt % |

TABLE 3B

| | Inventive Example J | Inventive Example K | Inventive Example L | Inventive Example M | Inventive Example N |
|---|---|---|---|---|---|
| Gearbox Efficiency (%) | 77.6 | 77.8 | 76.9 | 77.3 | 77.4 |
| Kv 40 (cSt) | 445.5 | 447.5 | 435.0 | 488.4 | 476.2 |
| Kv 100 (cSt) | 45.2 | 48.2 | 54.0 | 76.1 | 57.2 |
| Viscosity Index (VI) | 162 | 170 | 195 | 237 | 192 |

Tables 1A-1B, 2A-2B and 3A-3B illustrate the blended lubricating compositions of Examples A-D and J-N provide a kinematic viscosity of 435 cSt at 40° C. to 488 cSt at 40° C.; a kinematic viscosity of 45 cSt at 100° C. to 77 cSt at 100° C.; and a viscosity index of 162 to 239. Tables 1, 2 and 3 also illustrate the lubricating compositions of Comparative Examples E-I provide comparable kinematic viscosities, of 470 cSt at 40° C. to 510 cSt at 40° C.; a kinematic viscosity of 48 cSt at 100° C. to 80 cSt at 100° C.; a viscosity index of 163 to 253.

Tables 1A-1B, 2A-2B and 3A-3B illustrate the inventive lubricating compositions of Examples A-D and J-N provide an efficiency about 2-3% greater than the comparative lubricating compositions of Examples E-H. The efficiencies of the inventive lubricating compositions of Inventive Examples A-D and J-N are from 77% to 79%. The lubricating composition of Inventive Example A has an efficiency of 78.8%, which indicates 78.8% of available energy was used by the worm drive gear, and 21.2% is lost to friction or other factors.

The lubricating compositions of Comparative Examples E-H have an efficiency of from 74% to 75%. The higher efficiency of the inventive lubricating compositions of Examples A-D and J-N leads to lower operating temperatures and related benefits, including lower energy consumption, lower energy costs, longer machine life, and longer seal life. Even a small increase in efficiency, such as a 1.0% increase, provides significant energy and operational cost savings.

Although Comparative Example I provides an efficiency of 78.9%, Comparative Example I absorbs a greater amount of water than Inventive Examples A-D and J-N, which leads to rust and other undesirable effects. Thus, Inventive Examples A-D and are preferred over Comparative Example I.

The principles and modes of operation of this invention have been described above with reference to various exemplary and preferred embodiments. As understood by those of skill in the art, the overall invention, as defined by the claims, encompasses other preferred embodiments not specifically enumerated herein.

What is claimed is:

1. A lubricating composition comprising in admixture:

at least 45 wt. % and up to 75 wt. % of a Group V base oil component comprising alkylated naphthalenes, based on the total weight of the blend components that are used to produce the lubricating composition, with the Group V base oil component having a kinematic viscosity of 5 to less than or equal to 12 cSt at 100° C.; and from 24.55 wt. % to 45 wt. % of a polyolefin base oil component, based on the total weight of the blend components that are used to produce the lubricating composition, with the polyolefin base oil component including one or more PAO base stocks having a kinematic viscosity of at least 150 cSt and not greater than 2000 cSt at 100° C., wherein the Group V base oil component and polyolefin base oil component together comprise at least 90 wt. % of the lubricating composition, and wherein the lubricating composition yields a gear box efficiency in a worm drive gear box at least 1.8% greater than a similar lubricating composition including alkylated naphthalene at less than 45 wt. %.

2. The lubricating composition of claim 1, wherein the lubricating composition is comprised of from 50 wt. % to 75 wt. % of the a Group V base oil component, based on the total weight of the blend components that are used to produce the lubricating composition.

3. The lubricating composition of claim 1, wherein the Group V base oil component has an aniline point of at least −5° C.

4. The lubricating composition of claim 1, wherein the Group V base oil component has a hygroscopicity less than that of glycol.

5. The lubricating composition of claim 1, wherein the polyolefin base oil component has a $M_w$ of about 200,000 or less.

6. The lubricating composition of claim 1, wherein the polyolefin base oil component has a MWD of greater than 1 and less than 5.

7. The lubricating composition of claim 1, wherein the polyolefin base oil component is comprised of less than 5 wt % of polyolefin with $C_{20}$ or lower carbon numbers.

8. The lubricating composition of claim 1, wherein the lubricant composition is comprised of a blend of components containing not greater than 5 wt % of any of a Group I-III base oil component.

9. The lubricating composition of claim 1, wherein the lubricating composition has a kinematic viscosity of from 435.2 cSt to 487.2 cSt at 40° C.

10. The lubricating composition of claim 1, wherein the lubricating composition has an ISO VG grade of from 150 to 6,800.

11. A method for producing a lubricating composition, comprising blending together at least the following blend components:

at least 45 wt. % and up to 75 wt. % of a Group V base oil component comprising alkylated naphthalenes, based on the total weight of the blend components that are used to produce the lubricating composition, with the Group V base oil component having a kinematic viscosity of 5 to less than or equal to 12 cSt at 100° C.; and from 24.55 wt. % to 45 wt. % of a polyolefin base oil component, based on the total weight of the blend components that are used to produce the lubricating composition, with the polyolefin base oil component including one or more PAO base stocks having a kinematic viscosity of at least 150 cSt and not greater than 2000 cSt at 100° C., wherein the Group V base oil component and polyolefin base oil component together comprise at least 90 wt. % of the lubricating composition, and wherein the lubricating composition yields a gear box efficiency in a worm drive gear box at least 1.8% greater than a similar lubricating composition including alkylated naphthalene at less than 45 wt. %.

12. The method of claim 11, wherein the blend components are comprised of from 50 wt. % to 75 wt. % of the Group V base oil component, based on the total weight of the blend components that are used to produce the lubricating composition.

13. The method of claim 11, wherein the Group V base oil component has an aniline point of at least −5° C.

14. The method of claim 11, wherein the Group V base oil component has a hygroscopicity less than that of glycol.

15. The method of claim 11, wherein the lubricating composition is produced from a blend of components containing not greater than 5 wt % of any of a Group I-III base oil component.

16. A method for improving energy efficiency of a lubricating composition used in a worm drive gear box, comprising providing in the worm drive gear box a lubricating composition of at least the following blend components:

at least 45 wt. % and up to 75 wt. % of a Group V base oil component comprising alkylated naphthalenes, based on the total weight of the blend components that are used to produce the lubricating composition, with the Group V base oil component having a kinematic viscosity of 5 to less than or equal to 12 cSt at 100° C.; and from 24.55 wt. % to 45 wt. % of a polyolefin base oil component, based on the total weight of the blend components that are used to produce the lubricating composition, with the polyolefin base oil component including one or more PAO base stocks having a kinematic viscosity of at least 150 cSt and not greater than 2000 cSt at 100° C., wherein the Group V base oil component and polyolefin base oil component together comprise at least 90 wt. % of the lubricating composition, and wherein the lubricating composition yields a gear box efficiency in a worm drive gear box at least 1.8% greater than a similar lubricating composition including alkylated naphthalene at less than 45 wt. %.

17. The method of claim 16, wherein the blend components are comprised of from 50 wt. % to 75 wt. % of the Group V base oil component, based on the total weight of the blend components that are used to produce the lubricating composition.

18. The method of claim 16, wherein the Group V base oil component has an aniline point of at least −5° C.

19. The method of claim 16, wherein the Group V base oil component has a hygroscopicity less than that of glycol.

20. The method of claim 16, wherein the lubricating composition is produced from a blend of components containing not greater than 5 wt % of any of a Group I-III base oil component.

* * * * *